US007520237B1

(12) United States Patent
Dimov Zhekov

(10) Patent No.: US 7,520,237 B1
(45) Date of Patent: Apr. 21, 2009

(54) HURRICANE PREVENTION SYSTEM AND METHOD

(76) Inventor: Vladimir Dimov Zhekov, 819 Peacock Plz. PMB #653, Key West, FL (US) 33040

( * ) Notice: Subject to any disclaimer, the term of this patent is extended or adjusted under 35 U.S.C. 154(b) by 0 days.

(21) Appl. No.: 11/839,131

(22) Filed: Aug. 15, 2007

Related U.S. Application Data

(60) Provisional application No. 60/838,078, filed on Aug. 16, 2006.

(51) Int. Cl.
*B63B 35/44* (2006.01)

(52) U.S. Cl. ..... 114/264; 210/143

(58) Field of Classification Search ..... 114/264, 114/267, 382; 441/1; 405/303; 210/143
See application file for complete search history.

(56) References Cited

U.S. PATENT DOCUMENTS

2002/0009338 A1* 1/2002 Blum et al. ..... 405/303
2007/0084767 A1* 4/2007 Barber ..... 210/143
2007/0084768 A1* 4/2007 Barber ..... 210/143
2007/0101921 A1* 5/2007 Goldschmidt ..... 114/382
2007/0270057 A1* 11/2007 Feldman et al. ..... 441/1

* cited by examiner

*Primary Examiner*—Lars A Olson
(74) *Attorney, Agent, or Firm*—Gold & Rizvi, P.A.; H. John Rizvi; Glenn E. Gold

(57) ABSTRACT

The hurricane prevention system and method for use in ocean water is provided including a buoyant platform on which is disposed a wind-driven power source, a water-moving system, and a water-dispersing system. The wind-driven power source is configured to use wind energy to power the water-moving system, which is configured to transport water from somewhat deeper ocean water levels to, or near, the level of the ocean. The water-dispersing system is preferably configured to disperse the water from the water-moving system to an area at or near the sea surface. The buoyant platform preferably is anchored by a mooring system. The hurricane prevention system and method is designed to bring cooler water from deeper in the ocean to or near the ocean surface and to disperse that cooler water in that area to reduce the sea surface temperature, thereby preventing or inhibiting the formation of hurricanes.

17 Claims, 5 Drawing Sheets

HURRICANE PREVENTION SYSTEM AND METHOD

CROSS-REFERENCE TO RELATED APPLICATION

This application claims the benefit of co-pending U.S. Provisional Patent Application Ser. No. 60/838,078, filed Aug. 16, 2006, which is incorporated herein in its entirety.

BACKGROUND OF THE INVENTION

1. Field of the Invention

The present invention relates generally to hurricane suppression or prevention devices and methods, and more particularly, to a hurricane prevention system configured to cool the surface of the ocean water to suppress or prevent hurricanes.

2. Description of the Prior Art

Every year hurricanes extract a huge cost to society in terms of property damage, economic devastation, disruption of businesses and personal life, and, even more, in the number of lives lost. While many attempts have been made to mitigate the damage caused by hurricanes, there is an absence of attempts to actually stop the damage at its source—by attempting to prevent or inhibit the formation of hurricanes.

A study published Mar. 17, 2006 in the journal *Science zdetailed a study of hurricanes since* 1970, which definitively showed that the current rise in the world's sea surface temperatures is the primary contributor to the formation of stronger hurricanes. The new study also reported an alarming trend in the increase in the number of major hurricanes. In the 1970s, the average number of intense Category 4 and 5 hurricanes occurring globally was about 10 per year. Since 1990 the number has nearly doubled, averaging about 18 a year. It is postulated that the trend will continue as sea surface temperatures rise as a side effect of global warming.

It is well known to those in the art that formation of hurricanes requires water temperatures of at least 26.5° C. (80° F.) down to a depth of at least 50 m (150 feet). The huge societal cost of each hurricane coupled with the alarming increase in the number of hurricanes emphasize the importance of providing a system and method to reduce the sea surface temperature to below 26.5° C., thereby preventing or inhibiting the formation of hurricanes.

Accordingly, there is an established need for an effective, feasible hurricane prevention system and method capable of suppressing, inhibiting, or preventing the formation of hurricanes.

SUMMARY OF THE INVENTION

The present invention is directed to a viable, effective hurricane prevention system and method that is capable of bringing cooler water from deeper in the ocean to, or near, the ocean surface and is capable of dispersing the cooler water so that when the cooler water is mixed with the warmer surface water, the sea surface temperature is reduced, thereby preventing or inhibiting the formation of hurricanes. The hurricane prevention system and method includes a buoyant platform on which is disposed a wind-driven power source, a water-moving system, and a water-dispersing system. The wind-driven power source uses wind energy to power the water-moving system, which is configured to transport water from somewhat deeper ocean water levels to, or near, the level of the ocean. The water-dispersing system is preferably configured to disperse the water from the water-moving system to an area at, or near, the sea surface. The buoyant platform preferably is anchored by a mooring system. Preferably numerous buoyant platforms, each with at least one wind-driven power source, at least one water-moving system, and at least one water-dispersing system, are spaced in appropriate locations in the area of the ocean where hurricanes form.

An object of the present invention is to provide a hurricane prevention system and method that can be adapted for use in the areas of the ocean where hurricane formation takes place.

A further object of the present invention is to provide a hurricane prevention system and method that decreases the sea surface temperature.

Another object of the present invention is to provide a hurricane prevention system and method that is configured to reduce the number of hurricanes formed.

An additional object of the present invention is to provide a hurricane prevention system that is configured to use the energy of wind to move cooler deeper water to the sea surface.

These and other objects, features, and advantages of the present invention will become more readily apparent from the attached drawings and from the detailed description of the preferred embodiments, which follow.

BRIEF DESCRIPTION OF THE DRAWINGS

The preferred embodiments of the invention will hereinafter be described in conjunction with the appended drawings, provided to illustrate and not to limit the invention, where like designations denote like elements, and in which.

Like reference numerals refer to like parts throughout the several views of the drawings.

DETAILED DESCRIPTION OF THE PREFERRED EMBODIMENTS

Shown throughout the figures, the present invention is directed toward a viable, effective hurricane prevention system and method that is capable of bringing cooler water from deeper in the ocean to, or near, the ocean surface and is capable of dispersing the cooler water at the ocean surface. This results in a reduction of the sea surface temperature, and thereby prevents or inhibits the formation of hurricanes (otherwise known as tropical cyclones or typhoons).

Figure 1:
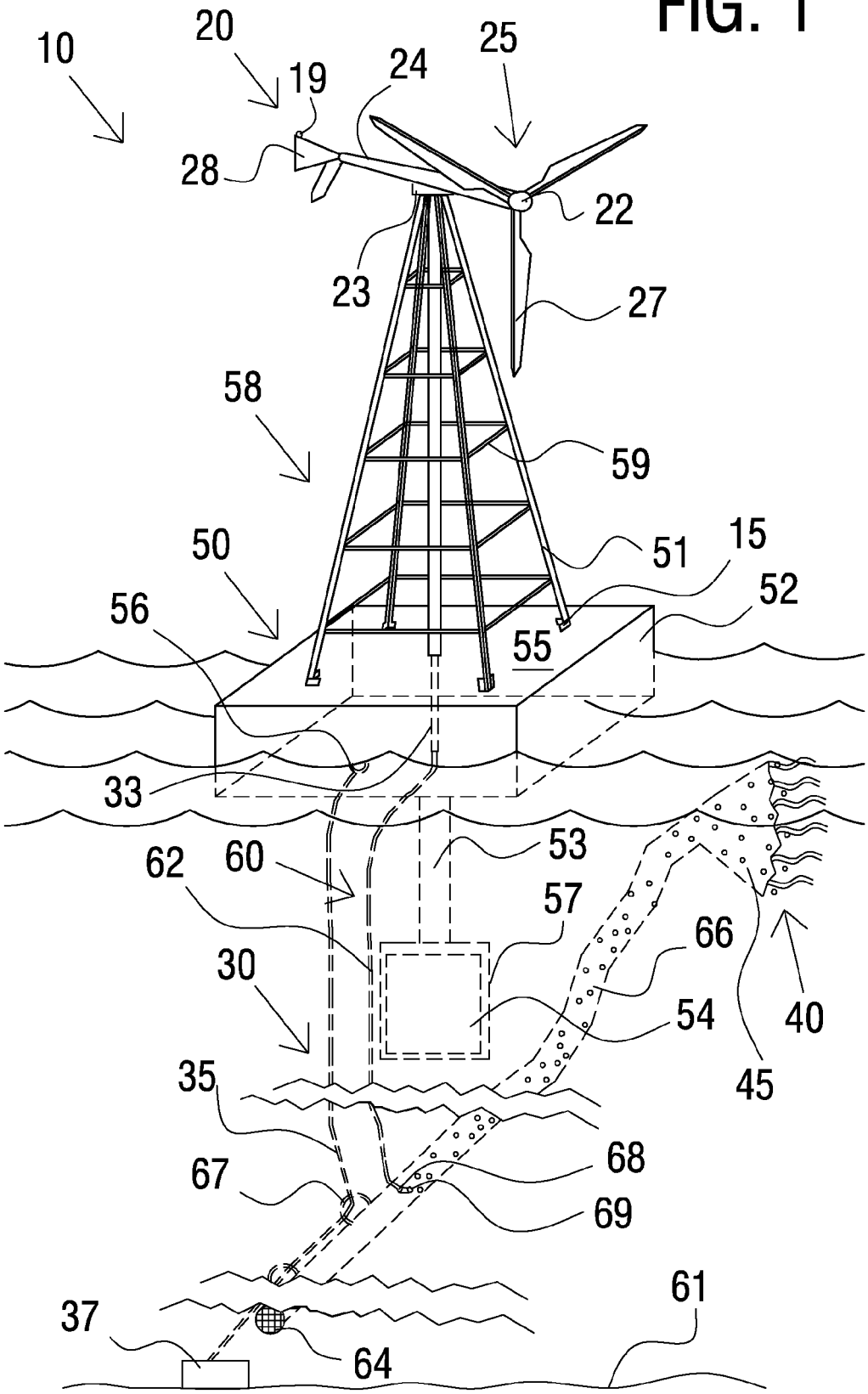
FIG. 1 is a perspective view showing a first preferred embodiment of the hurricane prevention system of the present invention.

Referring now to FIG. 1, a hurricane prevention system, shown generally as reference number 10, is illustrated in accordance with a preferred embodiment of the present invention. As shown, the hurricane prevention system 10 includes a wind-driven power source 20, a water-moving system 60, a water-dispersing system 40, a buoyant platform 50, and a mooring system 30. Hurricane prevention system 10 is configured for offshore operation in an ocean area where hurricanes form.

The buoyant platform 50 includes an upper base section 52, mid base section 53, and lower base section 57. The buoyant platform 50 is configured such that it has sufficient buoyancy to support the weight of the wind-driven power source 20 and to restrain pitch, roll, and heave motions within acceptable limits, as is known in the art. The technical feasibility of an offshore buoyant platform 50 has been successfully demonstrated by the multitude of buoyant marine and offshore oil platforms that have been utilized for decades.

Upper base section 52 is configured to provide buoyancy to platform 50. Although upper base section 52 is illustrated as substantially square, it may take other shapes as well, such as rectangular, cylindrical, triangular, octagonal, and multi-sectional. The lower surface of upper base section 52 is preferably configured with at least one tether attachment 56.

Mid base section 53 extends below upper base section 52, and serves to connect upper base section 52 to lower base section 57. Lower base section 57, containing a weight ballast 54, is disposed below mid base section 53. Ballast 54 is preferably configured with weight sufficient to keep the buoyant platform 50 upright and with a distribution of the weight that provides added mass moment of inertia to reduce pitch motion of buoyant platform 50. Ballast 54 preferably comprises iron ore ballast, although other ballast suitable for weighting the structure, for example, concrete, iron, lead, magnetite, ballastcrete, sea water, or the like, can be used. Lower base section 57 can optionally be configured with adjustable ballast compartments utilizing pressure tanks (not shown) that can be partially filled with ballast and partially filled with air, so control over the buoyancy of buoyant platform 50 can be achieved, as is known in the art. Although buoyant platform 50 is illustrated as floating with deck 55 above the level of the water, submerging the platform 50 to minimize the structure exposed to wave loading may prove economically advantageous, and is within the scope of the invention.

The top surface of upper base section 52 is deck 55. A support structure or tower 58 is vertically mounted on deck 55 in a substantially central location. Tower 58 is configured to support the wind-driven power source 20. Tower 58 may be designed as a single upright support structure in a substantially central location (not illustrated) or may comprise structural beams forming upwardly converging legs 51 (as illustrated), secured together as a rigid upright structure with associated bracing 59, as illustrated. The bottoms of legs 51 are spaced apart on the horizontal plane of deck 55, with the tops of legs 51 proceeding upwardly, tapering closer together and intersecting at an apex, pivot connection 23. At vertical intervals, bracing 59 adds rigidity to the beam system. The tower-deck connections 15 between legs 51 of tower 58 and deck 55 are configured to be sufficiently robust to secure wind-driven power source 20 to deck 55 and to support wind-driven power source 20.

Wind-driven power source 20, affixed to and supported by the top of tower 58, is a wind power production system, windmill, or wind turbine, as is known in the art.

Wind-driven power source 20 comprises a nacelle 24, a housing or structure which houses all of the generating components. Nacelle 24 houses a drive train, a propeller 25, a yawing control mechanism, and associated electrical, control, support, and interconnection equipment. Propeller 25 is disposed anteriorly on nacelle 24, and a yawing control mechanism is preferably disposed posteriorly on nacelle 24. Although the hurricane prevention system 10 is illustrated with a horizontal axis wind-driven power source 20, a vertical axis wind-driven power source, as is known in the art, could equally well be used and is within the scope of the invention.

The nacelle 24 is supported by, and rotates on, pivot connection 23 on tower 58.

Propeller 25 comprises a hub 22, partially enclosed and supported by the nacelle 24, and at least one radially extending rigid blade 27 coupled to the hub and adapted to aerodynamically interact with the wind.

Preferably, as is herein illustrated, propeller 25 is comprised of three radiating blades 27 that are spaced at equal angles about a horizontal axis of rotation, generally referred to as a rotor. Blades 27 are individually coupled to a centrally located hub 22, which is connected to nacelle 24. Blades 27, extending in a vertical plane adjacent the side of the tower 58, are relatively long.

Propeller 25 is constantly maintained upwind of tower 58 by a yawing control mechanism supported by nacelle 24 that provides rotation about the vertical axis through pivot connection 23. The yawing control mechanism is illustrated as wind vane 28 in the first embodiment as shown in FIG. 1. For safety, optionally, a navigational warning light 19 is located on wind vane 28 (FIG. 1).

Figure 2:
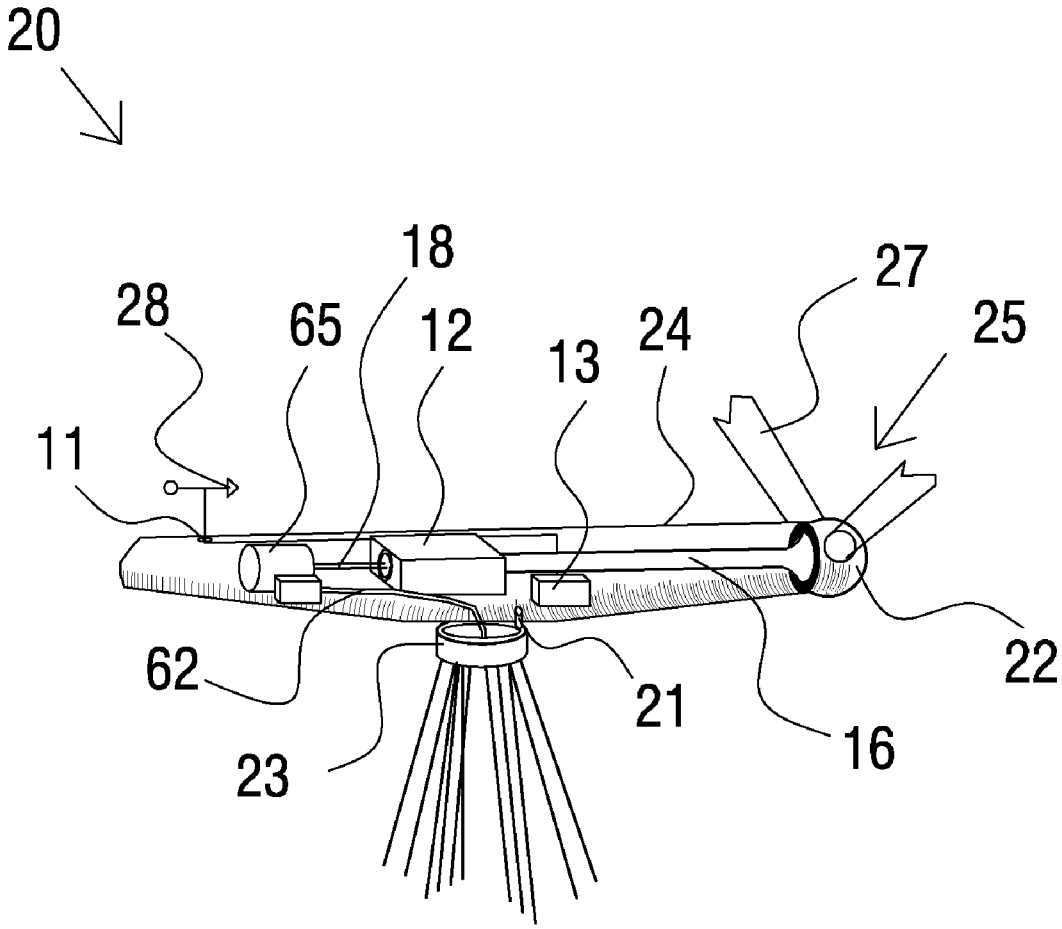
FIG. 2 is a diagrammatic, detail, cut-way view of the nacelle of a second embodiment of the hurricane prevention system of the present invention.

The second embodiment of FIG. 2 is substantially identical to the first embodiment of the hurricane prevention system 10, but illustrates a variation in the yawing control mechanism. The second embodiment includes a second type of yawing control mechanism with a wind-direction sensor 11 at the base of directional vane 29 operatively coupled with a servomotor or computer-controlled motor 13 to turn a yaw control device 21. The computer-controlled motor 13 causes the yaw control device 21 to turn the nacelle 24 so that the propeller 25 faces the wind.

Referring to the diagram of the interior components of nacelle 24 of FIG. 2, the rotor is operatively attached to the main shaft 16 so wind energy is converted into rotational shaft energy. Main shaft 16 operatively attaches to gearbox 12 which outputs energy to power air compressor 65. Gearbox 12 may optionally include other components such as are known in the art for optimum utilization of the available power at the appropriate torques, such as an automatically shiftable power transmission device or clutch (not shown).

The water-moving system 60 of the current invention is designed and configured as an air lift pump, as is known in the art, although other types of pumps could be utilized. The water-moving system 60 preferably comprises air compressor 65 (FIG. 2), an air line 62 (FIG. 1, FIG. 2), and a water pipe 66 (FIG. 2). Although a variety of differing air lift pumps may be utilized, the anticipated preferred capacity of the air lift pump of the present invention is approximately 3,000 liters/minute for each horsepower of engine utilized.

Air compressor 65, disposed within nacelle 24, is powered by wind-driven power source 20. Air line 62 is supported by tower 58 and is routed downward, preferably along the structure of tower 58, to upper base section 52 (FIG. 1). Upper base section 52 provides a conduit 33 through which air line 62 runs, with air line 62 exiting out the lower surface of upper base section 52 and running downward toward the lower, distal end of water pipe 66. Air line 62 fluidly connects air compressor 65 and water pipe 66, providing a pathway for the compressed air from air compressor 65 to travel down to a suitable depth, whereupon air line 62 is attached to discharge water pipe 66 at joint 68.

The compressed air delivered to water pipe 66 lifts an air/water mixture upward through water pipe 66 to the ocean surface or near the ocean surface. The principle generally being that an air/water mixture, with a density lower than the density of water, causes the water to move upward.

Optionally, a foot piece 69 is disposed at joint 68 within water pipe 66 and is configured to break the air into small bubbles, thereby conserving air and improving efficiency. The foot piece 69 will preferably be disposed at a depth of approximately 8-10 meters. Air line 62 is illustrated as running outside and parallel to water pipe 66, but the lower part of air line 62 can optionally be routed inside discharge water pipe 66 to reduce the likelihood of damage, if desired.

A benefit of the air lift pump is that servicing is simplified due to the fact that there are no moving or wearing components below the sea surface. Optionally, as a substitute for the air lift pump, water moving system 60 can be designed with wind-driven power source 20 charging batteries that can power a water pump on demand, or water can be directly pumped.

The buoyant platform 50 is a vertically moored floating structure configured to be suitable for ocean water depths within the application locations. The buoyant platform 50 is capable of being substantially permanently moored by means of a mooring system 30.

The mooring system 30 includes one or more mooring lines, illustrated as tether 35, whose upper end is secured to the tether attachment 56 of platform 50. It is anticipated that tether 35 will be formed of steel cable, although other suitable materials could be utilized. A single tether 35 may be used, or multiple tethers 35 may be used. For example, four tethers 35 can be used attached to one or more tether attachments 56, preferably located at substantially the four corners of upper base section 52. Any of the mooring systems as are known in the art may be used, the most common mooring systems being caternary moorings, taut-leg moorings, or vertical tension leg moorings. The choice of mooring type will be dependent not only upon the location, sea depth, and platform design, but also upon economics. The lower end of tether 35 is secured in a manner known in the art to sea floor 61 by anchor 37 (illustrated as a block of concrete). The anchor 37 can be of the available types as are well known, such as gravity-based anchors, drag-embedded anchors, driven pile anchors, suction anchors, driven anchor plates, torpedo embedded anchors, or drilled and grouted pile anchors. Because anchor selection factors—such as bottom soil shear strength, soil weight, and soil material—vary so widely, the anchor will preferably to be specifically designed for the bottom conditions present at the site of application.

Buoyant platform 50 is held in a stable manner by tether 35. Discharge water pipe 66 is preferably routed near tether 35 by means of fasteners 67. The lower end of water pipe 66 is preferably configured with a screen 64 to exclude marine life. The required depth that water pipe 66 is extended is determined by the depth of the water at the site of application of the present invention, but is generally in the area of 450 to 500 feet. At this depth the water temperature is generally around 11 degrees Celsius. The upward end of water pipe 66 is preferably configured with a spout or flat nozzle 45 that is capable of spreading this cooler water from deeper in the ocean. The flat nozzle 45 is preferably disposed at the surface of the water. The spreading of the cooler water increases the mixing of the cooler water with the warmer surface water, thereby lowering the sea surface temperature to below 26.5° C. (80° F.). When the sea surface water is lowered to below 25.5° C., the formation of hurricanes is prevented or inhibited.

Since it is at the approximate temperature of 26.5 degrees Celsius that hurricanes generally begin to form, optionally, the hurricane prevention system 10 can comprise a temperature sensor system with a thermometer for reading the water temperature near the water surface. If the temperature is cooler than approximately 25.5 degrees Celsius a signal is sent to deactivate the air compressor until the water temperature rises again, at which point the temperature sensor system reactivates the air compressor. For example, a clutch may be engaged or disengaged.

The hurricane prevention system 10 may be assembled in place, towed out to location, or placed on a barge to deliver it to location. (not shown) The buoyant platform deck 55 may additionally have communications and/or control equipment located upon it, providing data to study global or climate conditions. (not shown) While hurricane prevention system 10 is illustrated as a single-turbine floating platform 50, a multiple-turbine floating platform could be used, with multiple towers 58 (each supporting a wind-driven power source 20) located on a single larger platform. (not shown)

Figure 3:
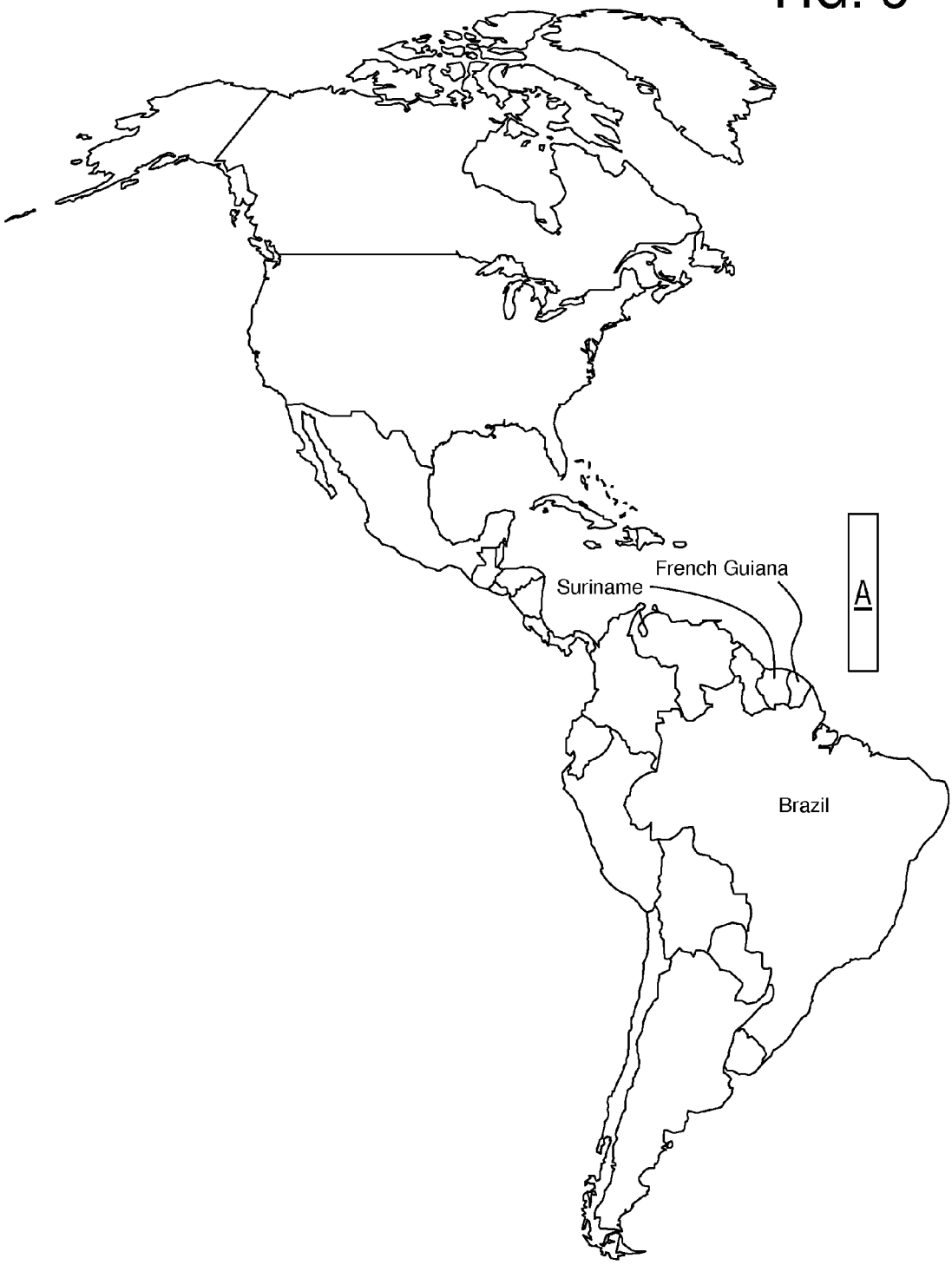
FIG. 3 is a map of North and South American showing an example of a general location of application of the hurricane prevention system of the present invention.
Figure 4:
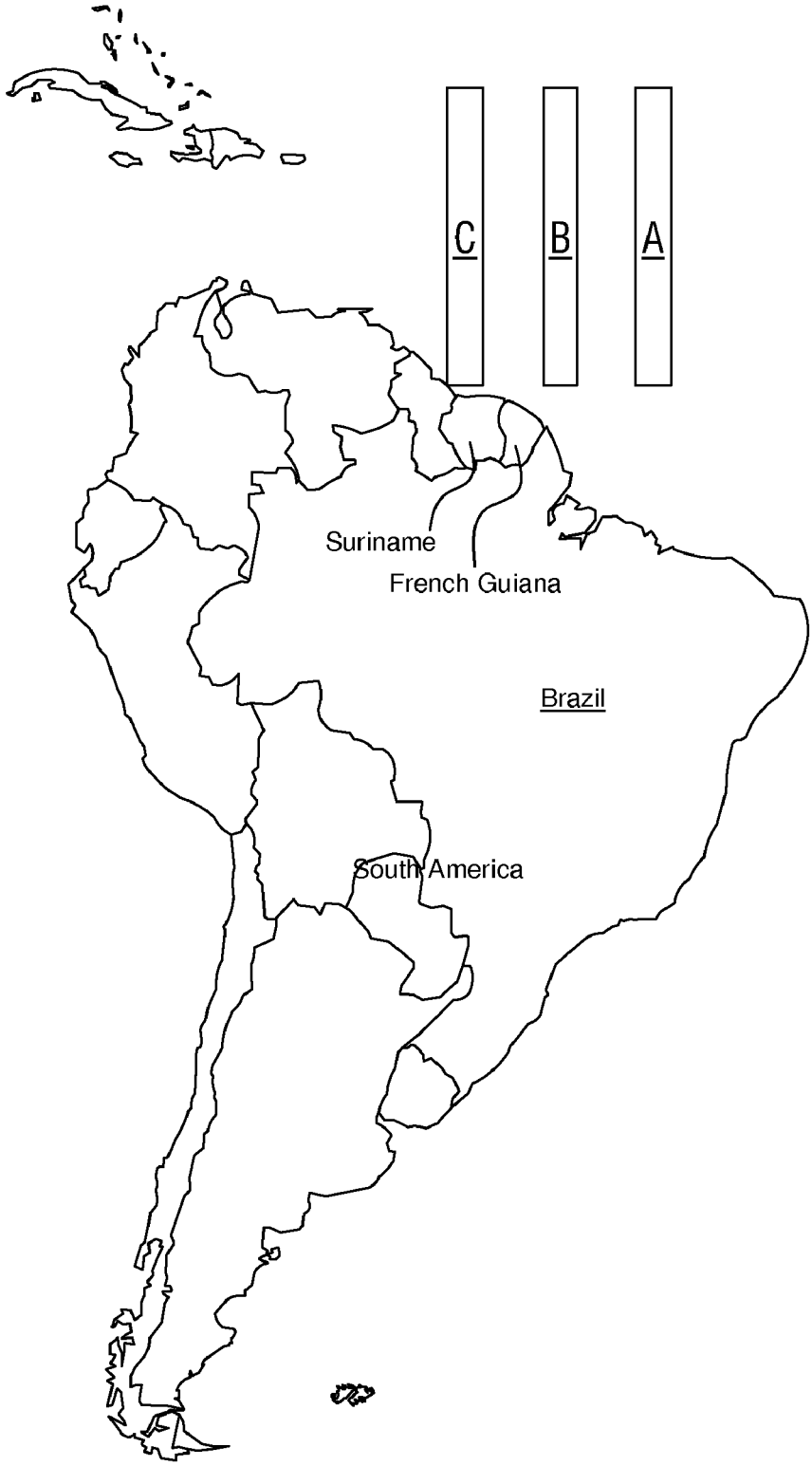
FIG. 4 is a map of South American showing an example of a general location of application of the hurricane prevention system of the present invention.

While the present invention can be utilized anywhere in the world, it is anticipated that the preferable initial use will be in the Atlantic Ocean slightly above the equator, in the general area north of the coasts of the countries of Guyana, Suriname, French Guiana, and Brazil (in the general area of 10° to 16° North and 44° West), in the north trade wind stream area, as shown in FIG. 3. It is in this area that the most dangerous hurricanes that strike the United States are formed. An array of individual modules of the hurricane prevention system 10 can be installed in a single northwardly extending group, illustrated as Array Area A in FIG. 3. Alternatively, multiple arrays of individual modules of the hurricane prevention system 10 can be installed in several groups placed some distance apart, as demonstrated by Array Area A, Array Area B, and Array Area C, in FIG. 4.

Figure 5:
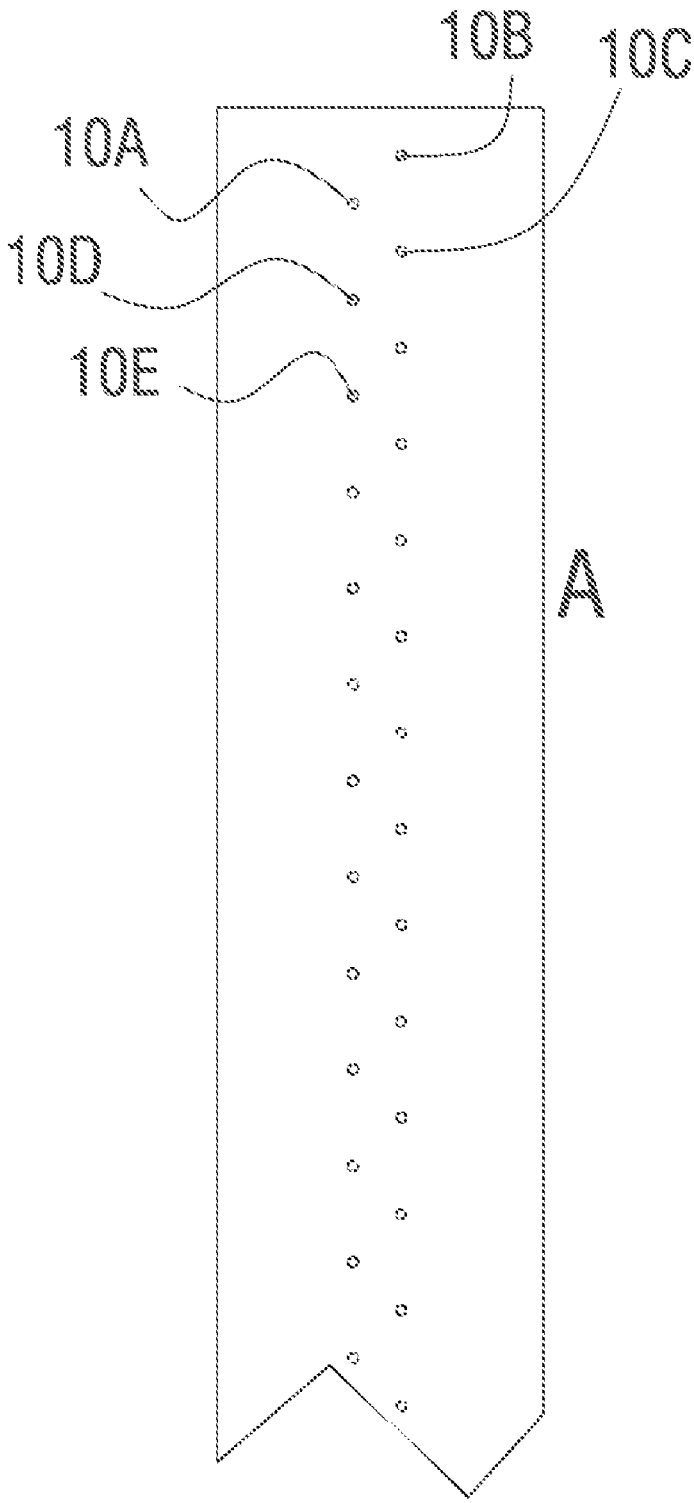
FIG. 5 is a diagram of the placement into an array of the individual modules of the hurricane prevention system of the present invention.

A variety of patterns and spacing can be used for the specific placement of the individual modules 10A, 10B, 10C, 10D, etc., of the hurricane prevention system 10 within the hurricane prevention system array. For example, FIG. 5 illustrates an offset pattern allowing an approximate distance of 1500 feet between the individual modules of the hurricane prevention system 10. A single offset row may be used, or, as illustrated, multiple offset rows may be used in the same array area. The specific configuration used will depend upon a variety of location specific factors including, for example, the ocean depth and the usual storm track pattern. The pattern of individual modules within the hurricane prevention system array, as well as the placement of the hurricane prevention system arrays, can be modified as required to meet the goal of reducing the sea surface temperature to below 26.5° C. It should be noted that 1 liter of water with a temperature of 10 degrees Celsius can generally cool 15 liters of water from a temperature of 26 degrees Celsius down to 25 degrees Celsius.

A possible auxiliary positive contribution of the hurricane prevention system 10 of the present invention, is that bringing the cooler water from deeper in the ocean to the surface additionally may bring water, nutrients, and/or other beneficial components to the surface, allowing for potential improvement of the environment for living organisms in the area of application. While water mass properties are highly asymmetric and site specific, potential may be realized to ameliorate depletion of oxygen in some areas of the ocean.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

I claim:

1. A hurricane prevention system for use in water of the ocean, comprising:

a buoyant platform;

a wind-driven power source disposed on the buoyant platform;

a water-moving system connected to the buoyant platform and powered by the wind-driven power source configured to transport the water from deeper in the ocean toward the surface of the ocean;

a water-dispersing system connected to the buoyant platform and configured to disperse the water from deeper in the ocean;

a mooring system configured to secure the buoyant platform in a generally stable position in relation to an ocean floor; and a temperature sensor system disposed on the buoyant platform configured to control the activation and deactivation of the hurricane prevention system.

2. The hurricane prevention system for use in water of the ocean as recited in claim 1, wherein the water-dispersing system comprises a spout.

3. The hurricane prevention system for use in water of the ocean as recited in claim 1, wherein the water-dispersing system comprises a flat nozzle.

4. The hurricane prevention system for use in water of the ocean as recited in claim 1, wherein the water-moving system comprises an air lift pump.

5. The hurricane prevention system for use in water of the ocean as recited in claim 4, wherein the water-moving system comprises an air compressor.

6. The hurricane prevention system for use in water of the ocean as recited in claim 5, wherein the air lift pump comprises:

a generally vertical discharge water pipe; and an air pipe fluidly connecting the air compressor to the generally vertical discharge water pipe.

7. The hurricane prevention system for use in water of the ocean as recited in claim 6, wherein the buoyant platform comprises:

an upper base section configured to provide buoyancy to the buoyant platform, the upper base section comprising an upper surface deck;

a lower base section comprising a ballast; and a mid-base section disposed below the upper base section and disposed above the lower base section, the mid-base section serving to connect the upper base section to the lower base section.

8. The hurricane prevention system for use in water of the ocean as recited in claim 1, wherein the wind-driven power source comprises:

a nacelle;

a propeller disposed anteriorly on the nacelle; and a yawing control mechanism disposed posteriorly on the nacelle.

9. The hurricane prevention system for use in water of the ocean as recited in claim 8, further comprising a tower to support the wind-driven power source and to secure the wind-driven power source to a deck of the buoyant platform.

10. The hurricane prevention system for use in water of the ocean as recited in claim 9, wherein the buoyant platform comprises:

an upper base section having at least one tether attachment and having an upper deck surface, wherein the tower is disposed on the upper deck surface;

a lower base section comprising a ballast;

a mid-base section disposed below the upper base section and disposed above the lower base section, the mid-base section serving to connect the upper base section to the lower base section;

at least one anchor; and at least one tether secured at its upward end to the at least one tether attachment of the upper base section of the buoyant platform and secured at its lower end to the at least one anchor.

11. The hurricane prevention system for use in water of the ocean as recited in claim 10, wherein the yawing control mechanism comprises a wind vane.

12. The hurricane prevention system for use in water of the ocean as recited in claim 11, wherein the at least one anchor is comprised of concrete.

13. The hurricane prevention system for use in water of the ocean as recited in claim 11, wherein the at least one tether is comprised of steel cable.

14. A method to inhibit the formation of hurricanes, comprising:

generating power via a wind-driven power source disposed on a buoyant platform;

powering a water-moving system with the power;

transporting water from deeper in an ocean toward a surface of the ocean via the water-moving system;

dispensing the water from deeper in the ocean near the surface of the ocean;

spreading the water from deeper in the ocean in a manner to cause the mixing of cooler water of the ocean surface with the water from deeper in the ocean;

sensing a temperature of the water near the surface of the ocean;

deactivating the water-moving system if the sensed temperature of the water near the surface of the ocean is cooler than approximately 25.5 degrees Celsius; and reactivating the water-moving system if the sensed temperature of the water nears the surface of the ocean is warmer than approximately 25.5 degrees Celsius.

15. The method to inhibit the formation of hurricanes as recited in claim 14, wherein the wind-driven power source is a wind turbine.

16. The method to inhibit the formation of hurricanes as recited in claim 15, wherein the water-moving system utilizes a generally vertical discharge water pipe to transport the water from deeper in the ocean to the ocean surface.

17. The method to inhibit the formation of hurricanes as recited in claim 16, further comprising:

transporting compressed air from an air compressor powered by the wind-driven power source to a lower area of the generally vertical discharge water pipe; and mixing the compressed air from the air compressor with the water in the generally vertical discharge water pipe, whereby the water in the generally vertical discharge water pipe is encouraged to rise toward the surface of the ocean.

* * * * *